United States Patent [19]

Iwahara

[11] 4,199,658

[45] Apr. 22, 1980

[54] BINAURAL SOUND REPRODUCTION SYSTEM

[75] Inventor: Makoto Iwahara, Yokohama, Japan

[73] Assignee: Victor Company of Japan, Limited, Yokohama, Japan

[21] Appl. No.: 940,361

[22] Filed: Sep. 7, 1978

[30] Foreign Application Priority Data

Sep. 10, 1977 [JP] Japan ..... 52-109175

[51] Int. Cl.[2] ..... H04R 5/04

[52] U.S. Cl. ..... 179/1 G; 179/1 GA

[58] Field of Search ..... 179/1 G, 1 GP, 1 GQ, 179/1 GA, 1 D, 100.4 ST

[56] References Cited

U.S. PATENT DOCUMENTS

| | | | |
|---|---|---|---|
| 3,892,917 | 7/1975 | Sotome | 179/1 GQ |
| 4,097,688 | 6/1978 | Ochi | 179/1 GQ |
| 4,118,599 | 10/1978 | Iwahara et al. | 179/1 GP |
| 4,136,260 | 1/1979 | Asahi | 179/1 G |
| 4,139,728 | 2/1979 | Haramoto et al. | 179/1 G |

FOREIGN PATENT DOCUMENTS

| | | | |
|---|---|---|---|
| 2308267 | 11/1976 | France | 179/1 G |

*Primary Examiner*—Douglas W. Olms

*Attorney, Agent, or Firm*—Lowe, King, Price & Becker

[57] ABSTRACT

The speaker system of the invention comprises a pair of inner and outer rightward loudspeakers and a pair of inner and outer leftward loudspeakers all of which are arranged such that their points of sound transmission are aligned on an equal vertical straight plane in front of a listener and the inner speaker of each pair is horizontally inwardly spaced from the outer speaker of the same pair a distance which is equal to the distance between the respective ears of the human head to thereby form a parallel crosstalk cancellation planes extending perpendicular to the frontal plane on which the speakers are arranged. A first crosstalk cancellation network is connected between the input circuits of the outer rightward speaker and the inner leftward speaker and a second crosstalk cancellation network is connected between the inner rightward speaker and the outer leftward speaker. Right- and left-channel binaural signals are applied to the inner right and leftward speakers, respectively.

7 Claims, 4 Drawing Figures

BINAURAL SOUND REPRODUCTION SYSTEM

BACKGROUND OF THE INVENTION

The present invention relates to binaural loudspeaker reproduction, and in particular to such a system wherein the crosstalk free listening point is provided anywhere on a pair of parallel vertical planes spaced apart a distance equal to the distance between respective ears of the human head.

The binaural sound reproduction systems which have hitherto been proposed accompany disadvantages in that the listener must be seated in a predetermined position with respect to the loudspeakers if he desires to hear sound which is free from interference resulting from the presence of acoustic crosstalk paths which are nonexistant in headphone reproduction. A prior art method involves the use of a first rightward speaker, a second rightward speaker spaced behind the first, a first leftward speaker and a second leftward speaker spaced behind the first leftward speaker. The first rightward speaker and the secone leftward speaker constitute an isosceles triangle with the listener's left ear so as to form a left-side vertical plane which is equidistant from these speakers and crosses the listener's left ear, and the first leftward speaker and the second rightward speaker constitute an isosceles triangle with the listener's right ear forming a right-side vertical equidistant plane crossing the listener's right ear. In so far as the listener's respective ears are positioned on the right and left equidistant planes, crosstalk components are cancelled. However, these equidistant planes are at an angle to each other so that the space in which the listener can enjoy crosstalk-free reproduction is severely limited.

SUMMARY OF THE INVENTION

An object of the present invention is therefore to provide a binaural sound reproduction system which permits crosstalk-free sound reproduction in an increased space in which the listener is allowed to move his head without disturbing crosstalk cancellation.

The present invention contemplates the use of a pair of inner and outer rightward speakers and a pair of inner and outer leftward speakers all of which are arranged such that their points of sound emission are equally aligned on a vertical rectilinear plane which faces a listener and the inner speaker of each pair is horizontally inwardly spaced from the outer speaker of the same pair a distance which is equal to the distance between the respective ears of the human head. A first crosstalk cancellation network is connected between the outer rightward speaker and the inner leftward speaker and a second crosstalk cancellation network is connected between the inner rightward speaker and the outer leftward speaker. Right and left channel binaural input signals are applied to the inner rightward speaker and the inner leftward speaker, respectively. The result is a formation of a pair of parallel equidistant straight vertical planes which extend normal to the frontal plane on which the speakers are aligned and which are spaced a distance equal to the distance between the listener's respective ears. On these equidistant planes the acoustic crosstalk components are cancelled. When the listener is seated so that his respective ears are positioned on the equidistant planes he will have sound pressures which are free from crosstalk interference. Because of the parallelism of the crosstalk cancellation planes, the listener is able to move his head back and forth free from the crosstalk interference effect so long as his respective ears are positioned on the equidistant planes.

BRIEF DESCRIPTION OF THE DRAWINGS

The invention will be further described with reference to the accompanying drawings, in which.

DETAILED DESCRIPTION

Figure 1:
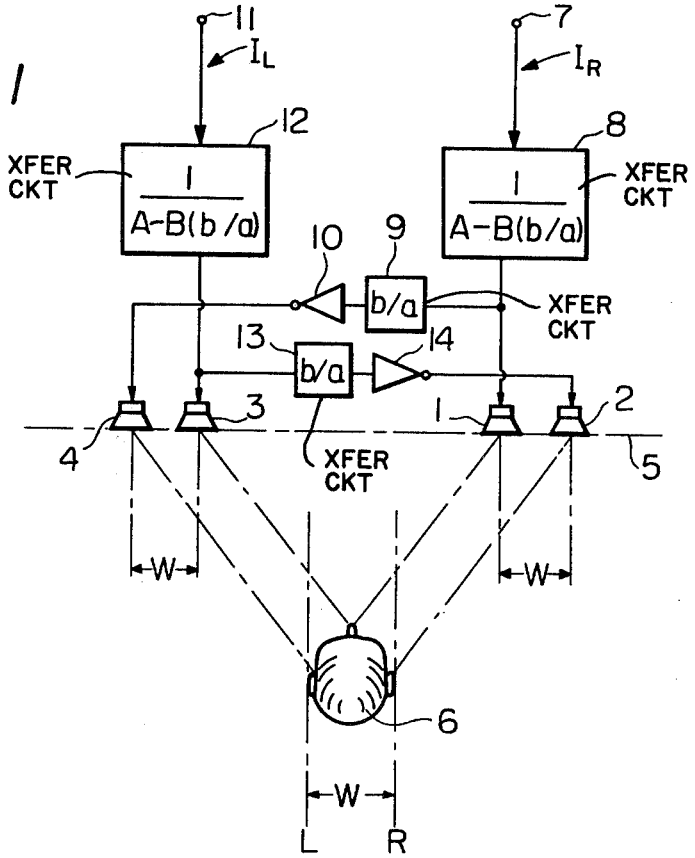
FIG. 1 is a schematic diagram of an embodiment of the invention.

In FIG. 1 there is shown a binaural loudspeaker reproduction system of the invention in which a pair of rightward loudspeakers 1 and 2 and a pair of leftward loudspeakers 3 and 4 are arranged such that their frontal surface are made flush with each other on a vertical plane indicated by a chain-dot line 5. The rightward speakers 1 and 2 are spaced apart a distance "w" from each other, the distance "w" being the distance between the right and left ears of a listener 6. Likewise, the leftward speakers 3 and 4 are spaced apart a distance "w" from each other. The listener 6 is seated in a position such that his right ear is at equal distance from the speakers 2 and 3 and his left ear is at equal distances from the speakers 1 and 4. It is to be noted that the sound waves emitted from the speakers 2 and 3 cancel out each other on a vertical plane R which is flush with the right ear of the listener 6, and the sound waves emitted from the speakers 1 and 4 cancel out each other on a vertical plane L which is flush with the left ear of the listener 6. Therefore, so long as the listener is seated such that his right and left ears are positioned on the vertical planes R and L respectively, he is allowed to hear interference-free binaural sound. Since the planes R and L are parallel to each other, the range of interference-free areas is much increased as compared to the prior art arrangements.

Figure 2:
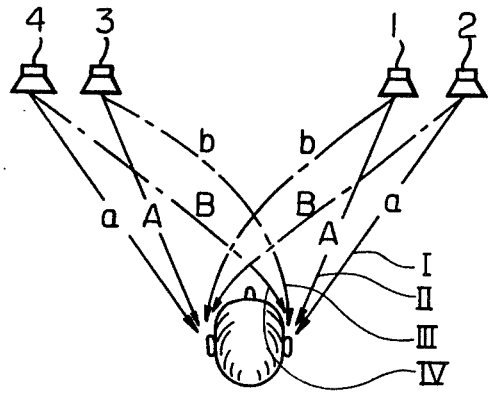
FIG. 2 illustrates acoustic paths between the speakers of FIG. 1 and a listener.

A right-channel binaural signal $I_R$ is applied to an input terminal 7 and thence to a transfer circuit 8 having a transfer function $1/(A-B(b/a))$ where A is the transfer function or characteristic of direct acoustic paths between the inside speakers 1 and 3 to the listener's right and left ears, respectively, "a" is the transfer function of direct acoustic paths between the outside speakers 2 and 4 and the listener's right and left ears, respectively, B is the transfer function of acoustic crosstalk paths between the outside speakers 2 and 4 and the listener's left and right ears, respectively, and "b" is the transfer function of acoustic crosstalk paths between the inside speakers 1 and 3 and the listener's left and right ears, respectively, as illustrated in FIG. 2.

The output signal from the transfer circuit 8 is applied to the speaker 1 on the one hand, and on the other to a second transfer circuit 9 having a transfer function b/a and thence to the speaker 4 through an inverter 10.

The left-channel binaural signal $I_L$ is applied to a left-channel input terminal 11 and thence to a third transfer circuit 12 having the same transfer function as the first transfer circuit 8, the output signal therefrom being applied to the speaker 3 on the one hand, and on the other to a fourth transfer circuit 13 having the same transfer function as the second transfer circuit 9 and thence to the speaker 2 via an inverter 14.

The sound signal components impinging at the listener's right ear over acoustic paths I, II, III and IV are thus given as follows (see FIG. 2):

| | |
|---|---|
| Acoustic path I | $-\frac{ab}{aA-bB}I_L$ |
| Acoustic path II | $+\frac{aA}{aA-bB}I_R$ |
| Acoustic path III | $+\frac{ab}{aA-bB}I_L$ |
| Acoustic path IV | $-\frac{bB}{aA-bB}I_R$ |

Alegebraic summation of the signal components on these acoustic paths results in cancellation of the signal components on paths I and II because they arrive at the listener's right ear at the same time, while the signal components over paths II and IV serve to reproduce the right-channel signal $I_R$ at the listener's right ear.

Because of the symmetrical arrangement of the system, the sound signal components impinging at the listener's left ear will give a similar result to that at the right ear so that the listener will hear the right- and left-channel binaural signals applied to the terminals 7 and 11 without crosstalk interference.

It is to be noted that crosstalk cancellation is accomplished in so far as the binaural correlation between right- and left-channel signals remains unchanged although their frequency response may be affected. The transfer function of the circuits 8 and 12 thus only affects the quality of sound, and in so far as these circuits have equal transfer functions, the binaural correlation between the right- and left-channel signals, and hence crosstalk cancellation, is unaffected. Stated differently, the transfer function of each of the circuits 8 and 12 may have a different transfer function from that described above in so far as these circuits have a same transfer function, while the transfer function of each of the crosstalk cancellation circuits 9 and 13 should be b/a. It is therefore the transfer function of the right-channel and left-channel crosstalk cancellation networks which contributes to the cancellation of crosstalks at the respective ears of the listener. The transfer circuits 8 and 12 may be so designed to have a transfer function that compensates for a particular response characteristic of the input binaural signals if they have already been processed in the broadcast station. However, if input signals have flat frequency, it is preferable that the transfer function of circuits 8 and 12 be $1/(A-B(b/a))$.

Figure 3:
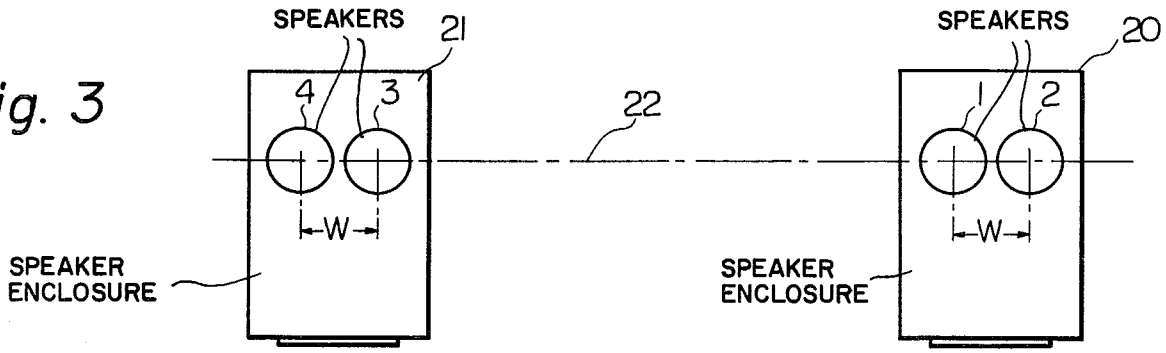
FIG. 3 is a frontal view of an arrangement of loudspeakers of FIG. 1.
Figure 4:
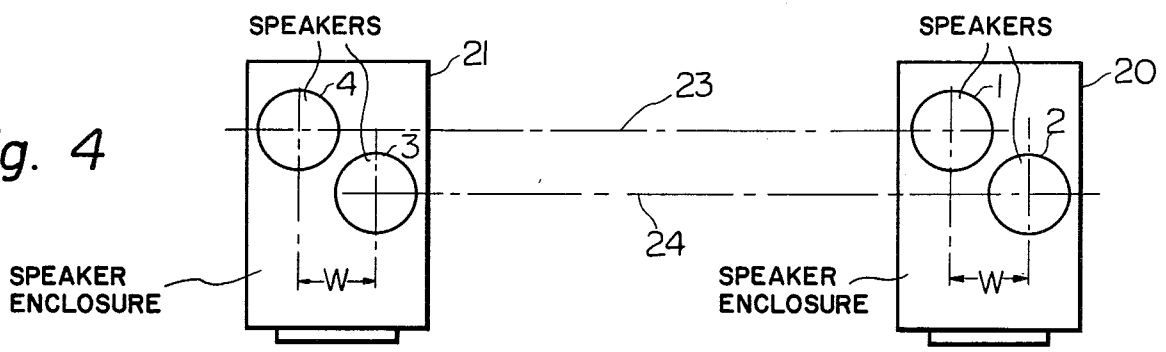
FIG. 4 is a frontal view of a modified arrangement of FIG. 3.

FIG. 3 is a frontal view of the loudspeakers 1 to 4, in which the diameter of each loudspeaker is smaller than the width "w" of the human head. The speakers 1 and 2 are shown housed in an enclosure 20 and the speakers 3 and 4 are in an enclosure 21, and all of the speakers are positioned at the same level from the floor surface so that their points of sound emission are aligned on the same horizontal line 22. FIG. 4 is a modification of the arrangement of FIG. 3 in which the diameter of each loudspeaker is larger than the width "w". The speakers 1 and 4 are obliquely positioned with respect to the speakers 2 and 3, respectively, while maintaining the distance "w" between them.

Since the crosstalk ratio b/a has a particular value in relation to a particular point in the reproduction area, the listener when positioned to correspond to that particular point would hear what is intended to reproduce so that a displacement of the listener's position from that particular point results in a sound which might differ from that which would be received at that particular point because of the different b/a value corresponding to the displaced position. It is found however that the deviation of the b/a value from the designed value is primarily of a variation of frequency response in the higher frequency range of audio spectrum and no substantial change is observed in the low to medium frequency ranges which are largely responsible for localization of sonic images. Therefore, the listener is given increased allowance in movement of his position without causing a loss of sonic localization.

What is claimed is:

1. A binaural sound reproduction system comprising:

a pair of inner and outer rightward loudspeakers and a pair of inner and outer leftward loudspeakers, all of which are arranged such that their points of sound emission are equally aligned on a vertical rectilinear plane and the inner loudspeaker of each pair is horizontally inwardly spaced from the outer loudspeaker of the same pair in said vertical plane a distance which is equal to the distance between the respective ears of the human head;

a first crosstalk cancellation network connected between said outer rightward loudspeaker and said inner leftward loudspeaker;

a second crosstalk cancellation network connected between said inner rightward loudspeaker and said outer leftward loudspeaker; and means for supplying right- and left-channel binaurally correlated signals to said inner rightward and leftward loudspeakers, respectively.

2. A binaural sound reproduction system as claimed in claim 1, wherein each of said first and second crosstalk cancellation networks comprises a filter and an inverter connected in series thereto.

3. A binaural sound reproduction system as claimed in claim 2, wherein said filter of each crosstalk cancellation network has a transfer function b/a wherein a is the transfer function of acoustic paths from said outer rightward and leftward loudspeakers to the listener's right and left ears, respectively, and b is the transfer function of acoustic crosstalk paths from said inner rightward and leftward loudspeakers to the listener's left and right ears, respectively.

4. A binaural sound reproduction system as claimed in claim 1, wherein all of said loudspeakers are arranged such that their points of sound emission are horizontally aligned to each other.

5. A binaural sound reproduction system as claimed in claim 1, wherein the loudspeakers of each pair are vertically equally spaced apart from each other and aligned on separate horizontal lines with the loudspeakers of the other pair.

6. A binaural sound reproduction system as claimed in claim 3, wherein said signal supplying means includes a first transfer circuit having a transfer function $1/(A-B(b/a))$ connected between a right-channel input terminal to which said right-channel binaural signal is applied and said inner rightward loudspeaker, and a second transfer circuit having the same transfer function as said first transfer circuit connected between a left-channel input terminal to which said left-channel binaural signal is applied and said inner leftward loudspeaker, wherein A is the transfer function of acoustic paths from said inner rightward and leftward loudspeakers to the listener's right and left ears respectively, and B is the transfer function of acoustic crosstalk paths from said outer rightward and leftward loudspeakers to the listener's left and right ears respectively.

7. A binaural sound reproduction system as claimed in claim 1, wherein said inner and outer loudspeakers of each pair are housed in a separate enclosure.

* * * * *